US008041278B2

(12) United States Patent
Baba et al.

(10) Patent No.: US 8,041,278 B2
(45) Date of Patent: Oct. 18, 2011

(54) HEATING DEVICE, FIXING DEVICE AND IMAGE FORMING DEVICE

(75) Inventors: Motofumi Baba, Kanagawa (JP); Takayuki Uchiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/429,642

(22) Filed: Apr. 24, 2009

(65) Prior Publication Data

US 2009/0290917 A1 Nov. 26, 2009

(30) Foreign Application Priority Data

May 23, 2008 (JP) ..... 2008-136079
Mar. 6, 2009 (JP) ..... 2009-054043

(51) Int. Cl.
*G03G 15/20* (2006.01)

(52) U.S. Cl. ..... 399/329; 219/619

(58) Field of Classification Search ..... 399/329, 399/328, 320; 219/619, 216, 469–471
See application file for complete search history.

(56) References Cited

U.S. PATENT DOCUMENTS 7,194,234 B2 * 3/2007 Katakabe et al. ..... 219/216
2009/0238593 A1 * 9/2009 Kinouchi et al. ..... 219/216
2009/0290915 A1 * 11/2009 Baba ..... 399/329
2009/0290916 A1 * 11/2009 Baba ..... 399/329

FOREIGN PATENT DOCUMENTS

JP 11-288190 10/1999
JP 2000-30850 1/2000
JP 3527442 B 2/2004

* cited by examiner

*Primary Examiner* — Susan Lee
(74) *Attorney, Agent, or Firm* — Morgan, Lewis & Bockius LLP

(57) ABSTRACT

A heating device includes: a magnetic field generating unit that generates a magnetic field; a heat-generating member that is disposed so as to face the magnetic field generating unit, and generates heat due to electromagnetic induction of the magnetic field, and having a heat-generating layer of a thickness that is thinner than a skin depth; and a temperature-sensitive member that is disposed so as to face a side of the heat-generating member opposite a side at which the magnetic field generating unit is located, a magnetic permeability of the temperature-sensitive member starting to decrease continuously from a magnetic permeability change start temperature that is in a temperature region that is greater than or equal to a set temperature and less than or equal to a heat-resistant temperature. A convex portion, that projects-out toward the heat-generating member from a surface that faces the heat-generating member, is provided at the temperature-sensitive member.

19 Claims, 15 Drawing Sheets

HEATING DEVICE, FIXING DEVICE AND IMAGE FORMING DEVICE

CROSS-REFERENCE TO RELATED APPLICATION

This application is based on and claims priority under 35 USC 119 from Japanese Patent Application No. 2008-136079 filed on May 23, 2008 and Japanese Patent Application No. 2009-054043 filed on Mar. 6, 2009.

BACKGROUND

1. Technical Field

The present invention relates a heating device, a fixing device and an image forming device.

2. Related Art

Conventionally, there are electromagnetic induction heat-generating type fixing devices that use, as the heat source, a coil that generates a magnetic field by being energized, and a heat-generating body that generates heat by eddy current arising due to electromagnetic induction of the magnetic field.

SUMMARY

A first aspect of the present invention is a heating device including: a magnetic field generating unit that generates a magnetic field; a heat-generating member that is disposed so as to face the magnetic field generating unit, and generates heat due to electromagnetic induction of the magnetic field, and having a heat-generating layer of a thickness that is thinner than a skin depth; and a temperature-sensitive member that is disposed so as to face a side of the heat-generating member opposite a side at which the magnetic field generating unit is located, a magnetic permeability of the temperature-sensitive member starting to decrease continuously from a magnetic permeability change start temperature that is in a temperature region that is greater than or equal to a set temperature and less than or equal to a heat-resistant temperature, and a convex portion, that projects out toward the heat-generating member from a surface that faces the heat-generating member, being provided at the temperature-sensitive member.

BRIEF DESCRIPTION OF THE DRAWINGS

Exemplary embodiments of the present invention will be described in detail based on the following figures, wherein.

DETAILED DESCRIPTION

A first exemplary embodiment of a heating device, a fixing device and an image forming device of the present invention will be described on the basis of the drawings.

Figure 1:
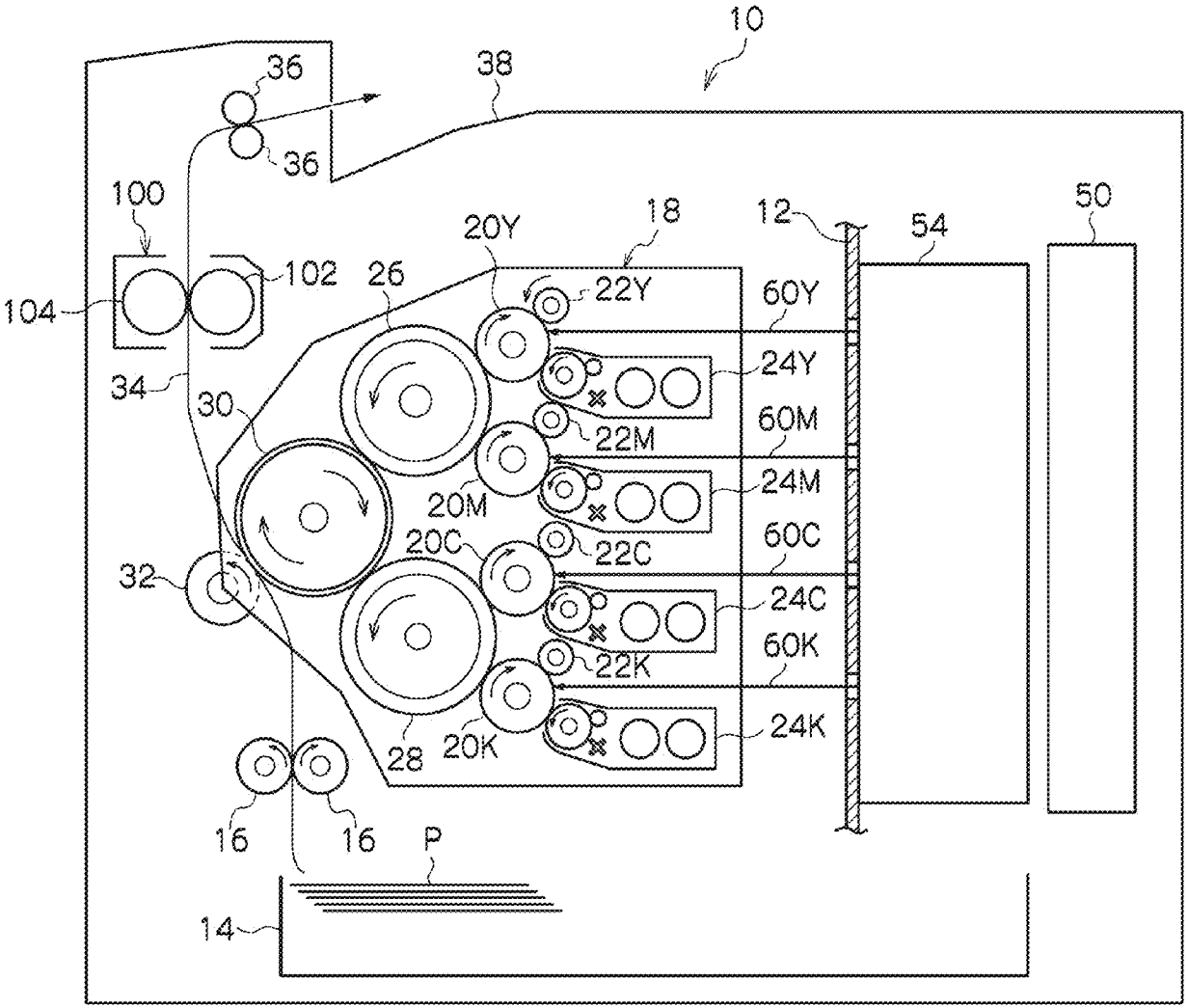
FIG. 1 is an overall view of an image forming device relating to a first exemplary embodiment of the present invention.

A printer 10 serving as an image forming device is shown in FIG. 1. In the printer 10, a light scanning device 54 is fixed to a housing 12 that structures the main body of the printer 10. A control unit 50, that controls the operations of the light scanning device 54 and each of the sections of the printer 10, is provided at a position adjacent to the light scanning device 54.

In the light scanning device 54, a light beam that exits from an unillustrated light source is scanned at a rotating polygon mirror and reflected by plural optical parts such as reflecting mirrors and the like, and light beams 60Y, 60M, 60C, 60K corresponding to respective toners of yellow (Y), magenta (M), cyan (C) and black (K) exit. The light beams 60Y, 60M, 60C, 60K are guided to photoconductive bodies 20Y, 20M, 20C, 20K, respectively.

A sheet tray 14 that accommodates recording sheets P is provided at the lower side of the printer 10. A pair of registration rollers 16, that adjust the position of the lead edge portion of the recording sheet P, are provided above the sheet tray 14. An image forming unit 18 is provided at the central portion of the printer 10. The image forming unit 18 is equipped with the four photoconductive bodies 20Y, 20M, 20C, 20K, and they are lined up in a row vertically.

Charging rollers 22Y, 22M, 22C, 22K, that charge the surfaces of the photoconductive bodies 20Y, 20M, 20C, 20K, are provided at the upstream sides in the directions of rotation of the photoconductive bodies 20Y, 20M, 20C, 20K. Developing units 24Y, 24M, 24C, 24K, that develop the toners of Y, M, C, K on the photoconductive bodies 20Y, 20M, 20C, 20K respectively, are provided at the downstream sides in the directions of rotation of the photoconductive bodies 20Y, 20M, 20C, 20K.

A first intermediate transfer body 26 contacts the photoconductive bodies 20Y, 20M, and a second intermediate transfer body 28 contacts the photoconductive bodies 20C, 20K. A third intermediate transfer body 30 contacts the first intermediate transfer body 26 and the second intermediate transfer body 28. A transfer roller 32 is provided at a position opposing the third intermediate transfer body 30. Due thereto, the recording sheet P is transported between the transfer roller 32 and the third intermediate transfer body 30, and the toner image on the third intermediate transfer body 30 is transferred onto the recording sheet P.

A fixing device 100 is provided downstream of a sheet transporting path 34 on which the recording sheet P is transported. The fixing device 100 has a fixing belt 102 and a pressure roller 104. The recording sheet P is heated and pressure is applied thereto, and the toner image is fixed on the recording sheet P. The recording sheet P on which the toner image is fixed is discharged-out by sheet transporting rollers 36 to a tray 38 provided at the top portion of the printer 10.

Image formation of the printer 10 will be described next.

When image formation is started, the surfaces of the respective photoconductive bodies 20Y through 20K are charged uniformly by the charging rollers 22Y through 22K, Then, the light beams 60Y through 60K that correspond to the output image are emitted from the light scanning device 54 onto the charged surfaces of the photoconductive bodies 20Y through 20K, and electrostatic latent images corresponding to respective color separation images are formed on the photoconductive bodies 20Y through 20K. The developing units 24Y through 24K selectively apply toners of the respective colors, i.e., Y through K, onto the electrostatic latent images, such that toner images of the colors Y through K are formed on the photoconductive bodies 20Y through 20K.

Thereafter, the magenta toner image is primarily transferred from the photoconductive body 20M for magenta to the first intermediate transfer body 26. Further, the yellow toner image is primarily transferred from the photoconductive body 20Y for yellow to the first intermediate transfer body 26, and is superposed on the magenta toner image on the first intermediate transfer body 26.

Similarly, the black toner image is primarily transferred from the photoconductive body 20K for black to the second intermediate transfer body 28. Further, the cyan toner image is primarily transferred from the photoconductive body 20C for cyan to the second intermediate transfer body 28, and is superposed on the black toner image on the second intermediate transfer body 28.

The magenta and yellow toner images, that were primarily transferred onto the first intermediate transfer body 26, are secondarily transferred onto the third intermediate transfer body 30. On the other hand, the black and cyan toner images, that were primarily transferred onto the second intermediate transfer body 28, also are secondarily transferred onto the third intermediate transfer body 30. Here, the magenta and yellow toner images, that were secondarily-transferred previously, and the cyan and black toner images, are superposed on one another, such that a full color toner image of colors (three colors) and black is formed on the third intermediate transfer body 30.

The full color toner image that is secondarily transferred reaches the nip portion between the third intermediate transfer body 30 and the transfer roller 32. Synchronously with the timing thereof, the recording sheet P is transported from the registration rollers 16 to the nip portion, and the full color toner image is tertiarily transferred onto the recording sheet P (final transfer).

Thereafter, the recording sheet P is sent to the fixing device 100, and passes-through the nip portion between the fixing belt 102 and the pressure roller 104. At this time, due to the working of the heat and the pressure provided from the fixing belt 102 and the pressure roller 104, the full color toner image is fixed on the recording sheet P. After fixing, the recording sheet P is discharged-out to the tray 38 by the sheet transporting rollers 36, and the formation of a full color image onto the recording sheet P ends.

The fixing device 100 relating to the present exemplary embodiment will be described next. Note that, in the present exemplary embodiment, the heat-resistant temperature of the fixing device 100 is set to 245° C., and the set fixing temperature is set to 170° C.

Figure 2A:
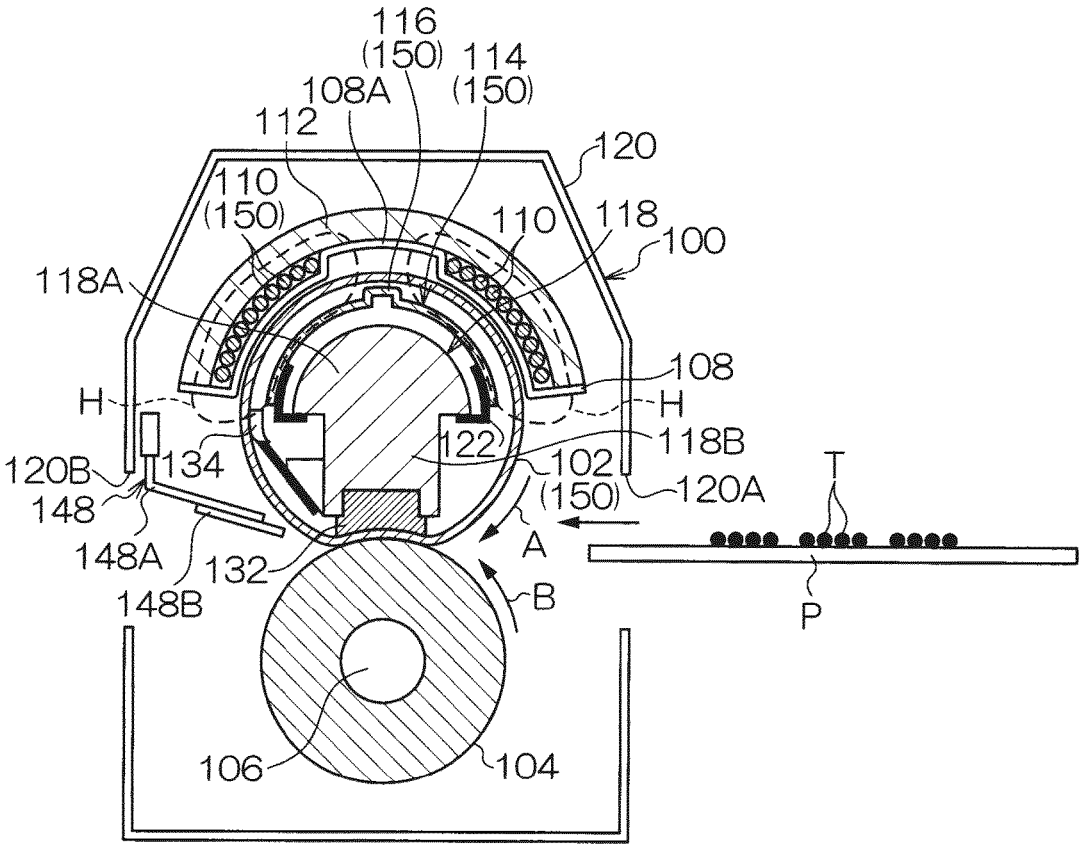
FIG. 2A and FIG. 2B are cross-sectional views of a fixing device relating to the first exemplary embodiment of the present invention.

As shown in FIG. 2A, the fixing device 100 has a housing 120 in which are formed openings 120A, 120B for carrying out entry and discharging of the recording sheet P. The fixing belt 102 that is endless is provided at the interior of the housing 120. Cap members (not shown), that are shaped as cylindrical tubes and have rotating shafts, are fit-together with and fixed to the both end portions of the fixing belt 102, such that the fixing belt 102 is supported so as to be able to rotate around these rotating shafts. Further, a gear, that is connected to a motor (not shown) that rotates and drives the fixing belt 102, is adhered to one of the cap members. Here, when the motor operates, the fixing belt 102 rotates in the direction of arrow A.

A bobbin 108, that is structured by an insulating material, is disposed at a position opposing the outer peripheral surface of the fixing belt 102. The bobbin 108 is formed substantially in the shape of an arc that follows the outer peripheral surface of the fixing belt 102. A convex portion 108A is provided so as to project-out from the substantially central portion of the surface of the bobbin 108 at the side opposite the side at which the fixing belt 102 is located. The gap between the bobbin 108 and the fixing belt 102 is around 1 to 3 mm.

An excitation coil 110, that generates a magnetic field H by being energized, is wound plural times in the axial direction (the depthwise direction of the drawing of FIG. 2A) around the convex portion 108A at the bobbin 108. A magnetic path forming member 112, that is a strong magnetic body and is formed in a substantial arc shape following the arc shape of the bobbin 108, is disposed at a position facing the excitation coil 110, and is supported by the excitation coil 110 or the bobbin 108.

Figure 2B:
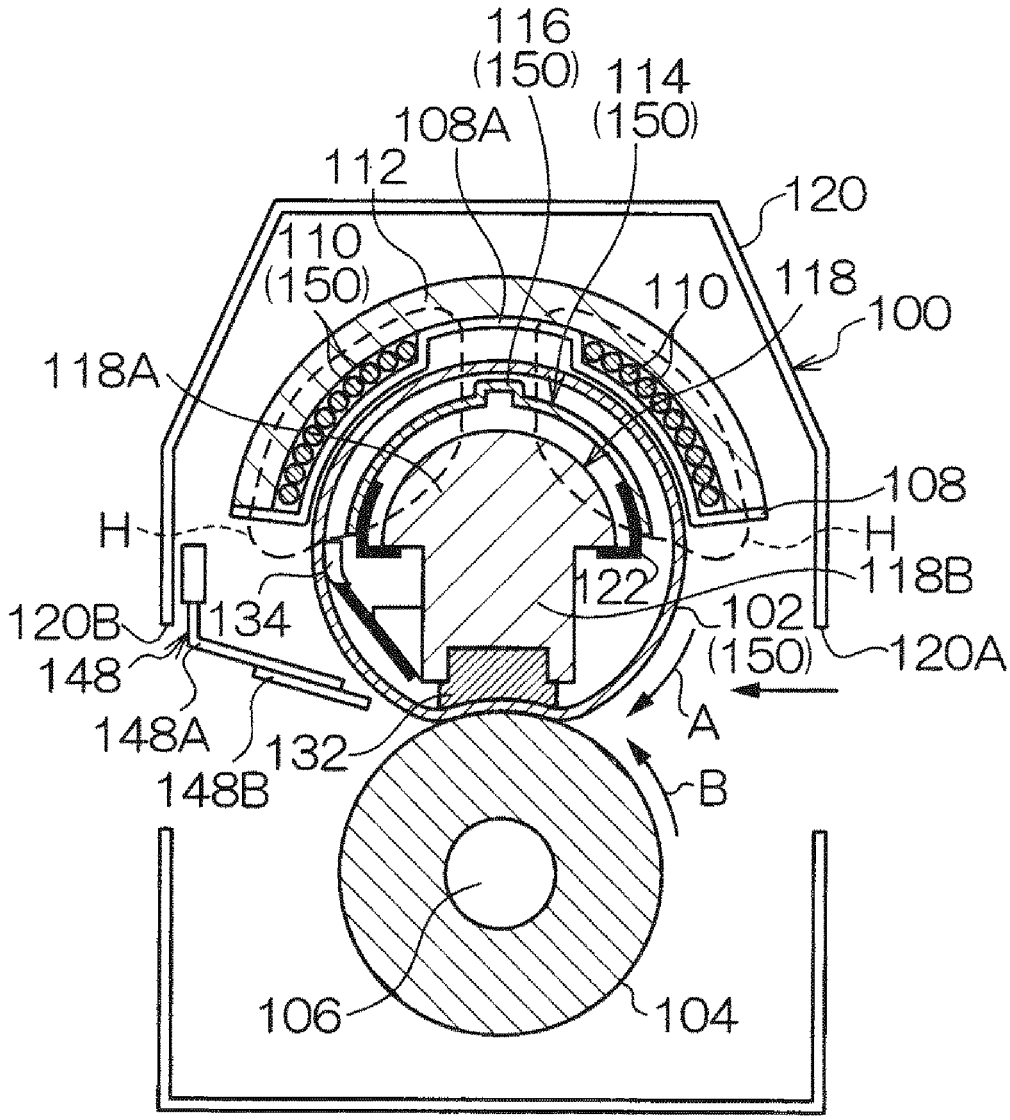

Here, the magnetic path of the magnetic flux H in FIG. 2A shows a state in which a temperature-sensitive magnetic member 114 that will be described later is lower than a magnetic permeability change start temperature (a state in which the temperature-sensitive magnetic member 114 is a strong magnetic body). If the temperature-sensitive magnetic member 114 is greater than or equal to the magnetic permeability change start temperature, the magnetic flux H forms a magnetic path such as in FIG. 2B.

For the magnetic path forming member 112, it suffices to use, for example, strong magnetic metal materials such as iron, nickel, chromium, manganese and the like, or alloys thereof, or oxides thereof, or the like. It suffices for the eddy current loss and the hysteresis loss to be low.

Soft ferrite, oxide-type soft magnetic metal materials, and the like are examples of materials having low eddy current loss and hysteresis loss.

Here, the structure of the fixing belt 102 will be described.

Figure 4A:
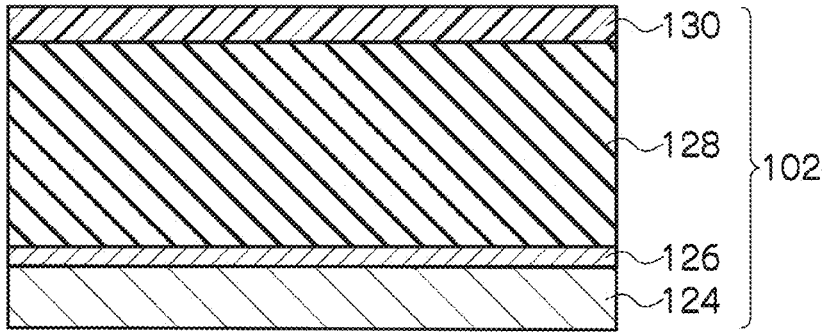
FIG. 4A is a cross-sectional view of a fixing belt relating to the first exemplary embodiment of the present invention.

As shown in FIG. 4A, the fixing belt 102 is structured by a base layer 124, a heat-generating layer 126, an elastic layer 128 and a releasing layer 130 from the inner side toward the outer side thereof These layers are laminated together and made integral. Further, the diameter of the fixing belt 102 is 30 mm, and the transverse direction length thereof is 300 mm.

A material that has strength to support the thin heat-generating layer 126 and is heat-resistant, while a magnetic field (magnetic flux) passes therethrough, either does not generate heat or at which it is difficult for heat to be generated due to the working of the magnetic field, can be appropriately selected as the base layer 124. A metal belt (as a non-magnetic metal, non-magnetic stainless steel for example) of a thickness of 30 to 200 μm (preferably 50 to 150 μm), a belt structured by a metal material formed from Fe, Ni, Co or alloys thereof such as Fe—Ni, Fe—Ni—Cr, Fe—Co, Ni—Co, Fe—Ni—Co, Fe—Cr—Co or the like, a resin belt (e.g., a polyimide belt) of a thickness of 60 to 200 μm, and the like are examples. In any case, the material (the specific resistance, the relative magnetic permeability) and the thickness are appropriately set such that the magnetic flux of the excitation coil 110 works to a temperature-sensitive member 114, as will be described later. In the present exemplary embodiment, non-magnetic stainless is used.

The heat-generating layer 126 is structured by a metal material that generates heat due to the working of electromagnetic induction in which eddy current flows so as to generate a magnetic field that cancels the aforementioned magnetic field H. In order for the magnetic flux of the magnetic field H to pass-through, the heat-generating layer 126 must be structured to be thinner than a skin depth that is the thickness that the magnetic field H can penetrate. Here, given that the skin depth is δ, the specific resistance of the heat-generating layer 126 is $\rho_n$, the relative magnetic permeability is $\mu_n$, and the frequency of the signal (current) at the excitation coil 110 is f, δ is expressed by formula (1).

[Formula 1]

$$\delta_n = 503\sqrt{\frac{\rho_n}{f \cdot \mu_n}} \quad (1)$$

For example, gold, silver, copper, aluminum, zinc, tin, lead, bismuth, beryllium, antimony, or a metal material that is an alloy thereof can be used as the metal material that is used for the heat-generating layer 126. Note that it is better to make the thickness of the heat-generating layer 126 as thin as possible also in order to shorten the warm-up time of the fixing device 100.

Here, in a range of AC frequency of 20 kHz to 100 kHz that a general-use power source can utilize, it is preferable to use, as the heat-generating layer 126, a non-magnetic metal (a paramagnetic body whose relative magnetic permeability is about 1) material whose thickness is 2 to 20 μm and whose specific resistance is less than or equal to $2.7\times10^{-8}$ Ωcm. Therefore, in the present exemplary embodiment, copper of a thickness of 10 μm is used as the heat-generating layer 126 from the standpoint of being able to efficiently obtain the needed heat generation amount, and also from the standpoint of low cost.

From the standpoint of obtaining excellent elasticity and heat resistance, and the like, a silicon rubber or a fluorine rubber is used as the elastic layer 128. In the present exemplary embodiment, silicon rubber is used. Further, the thickness of the elastic layer 128 in the present exemplary embodiment is 200 μm. Note that it is preferable to set the thickness of the elastic layer 128 within 200 μm to 600 μm.

The releasing layer 130 is provided in order to weaken the adhesive force with the toner T (see FIG. 2A) that is fused on the recording sheet P, and make the recording sheet P peel-away easily from the fixing belt 102. In order to obtain excellent surface releasability, a fluorine resin, silicon resin, or polyimide resin is used as the releasing layer 130, and PFA (tetrafluoroethylene—perfluoroalkoxyethylene copolymer resin) is used in the present exemplary embodiment. The thickness of the releasing layer 130 is 30 μm.

Figure 3:
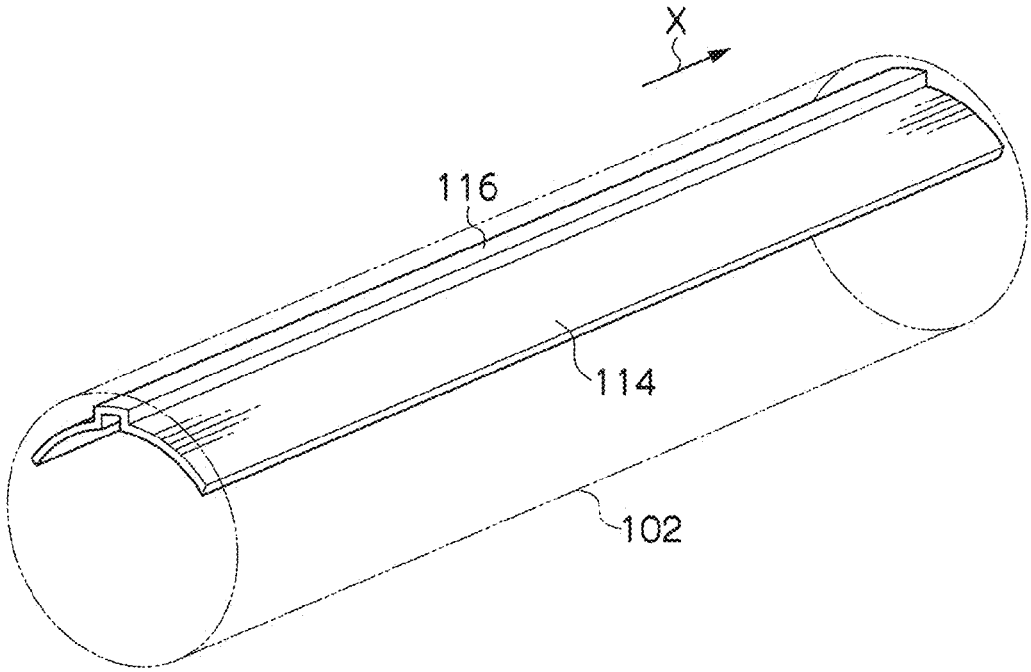
FIG. 3 is a perspective view of a temperature-sensitive magnetic member relating to the first exemplary embodiment of the present invention.

On the other hand, as shown in FIG. 2A and FIG. 3, the temperature-sensitive magnetic member 114, that is formed from a strong magnetic body substantially shaped as an arcuate plate and that faces the fixing belt 102 without contacting the fixing belt 102, is provided at the inner side of the fixing belt 102 so as to follow the inner peripheral surface of the fixing belt 102. The temperature-sensitive magnetic member 114 is disposed so as to face the excitation coil 110.

By the magnetic path forming member 112 that is a strong magnetic body and the temperature-sensitive magnetic member 114 that is also a strong magnetic body, the magnetic path of the magnetic field H generated from the excitation coil forms a main closed magnetic path such that the fixing belt 102 and the excitation coil 110 are sandwiched therebetween. As shown in FIG. 2A, the excitation coil 110 corresponds to an angular portion of about 140° with respect to the center (hereinafter called perfect circle reference center) in a case in which the fixing belt 102 is in a perfectly circular state. The magnetic path forming member 112 corresponds to an angular portion of about 150° with respect to the perfect circle reference center of the fixing belt 102. If the temperature-sensitive magnetic member 114 is disposed at a larger angular portion than the excitation coil 110, leaking of magnetic flux to the periphery can be made to be small, the power factor can be improved, and electromagnetic induction particularly to the metal members that are the structural parts at the interior of the fixing belt 102 can be prevented. Therefore, the heat-generating layer 126 of the fixing belt 102 can be heated by induction without loss.

Further, the thickness of the temperature-sensitive magnetic member 114 is 150 μm, and the outer peripheral length thereof is 40 mm. The temperature-sensitive magnetic member 114 corresponds to an angular portion of about 160° with respect to the perfect circle reference center of the fixing belt 102 (see FIG. 2C). Note that the thickness of the temperature-sensitive magnetic member 114 is set in the range of 50 to 200 μm.

A convex portion 116, that projects-out in the radial direction (the direction heading from the temperature-sensitive magnetic member 114 toward the fixing belt 102) and extends long in the longitudinal direction (the direction of arrow X in FIG. 3), is provided at a position of the temperature-sensitive magnetic member 114 which position faces the convex portion 108A of the bobbin 108 (a position that does not face the excitation coil 110). The height of the convex portion 116 of the temperature-sensitive magnetic member 114 (the amount of projection from the arcuate, curved surface) is 0.5 mm, and a width W thereof is 3 mm (see FIG. 2D). The average distance between the top surface of the convex portion 116 and the inner peripheral surface of the fixing belt 102 is set to be 0.5 to 1.5 mm. Note that the convex portion 116 is formed by drawing processing, and the thickness at the convex portion 116 is a thickness that is near to the thickness of the other arcuate, curved surface. Note that, although the convex portion 116 is substantially quadrangular in FIG. 2C, it suffices to set an appropriate shape as needed in order to appropriately adjust the movement of heat between the fixing belt 102 and the temperature-sensitive magnetic member 114. Note that, in FIG. 2D, the convex portion 116 is shaped as an arc of a radius of curvature R=3.5 mm.

The temperature-sensitive magnetic member 114 is structured of a material having the characteristic that the magnetic permeability starts to continuously decrease from a magnetic permeability change start temperature that is in a temperature region that is greater than or equal to the set heating temperature of the fixing belt 102 and less than or equal to the heat-resistant temperature of the fixing belt 102. Concretely, a magnetic shunt steel, an amorphous alloy or the like is used. It is preferable to use a metal alloy material formed from Fe, Ni, Si, B, Nb, Cu, Zr, Co, Cr, V, Mn, Mo or the like, for example, a binary magnetic shunt steel such as Fe—Ni or a ternary magnetic shunt steel such as Fe—Ni—Cr. In the present exemplary embodiment, an Fe—Ni alloy is used.

Figure 5:
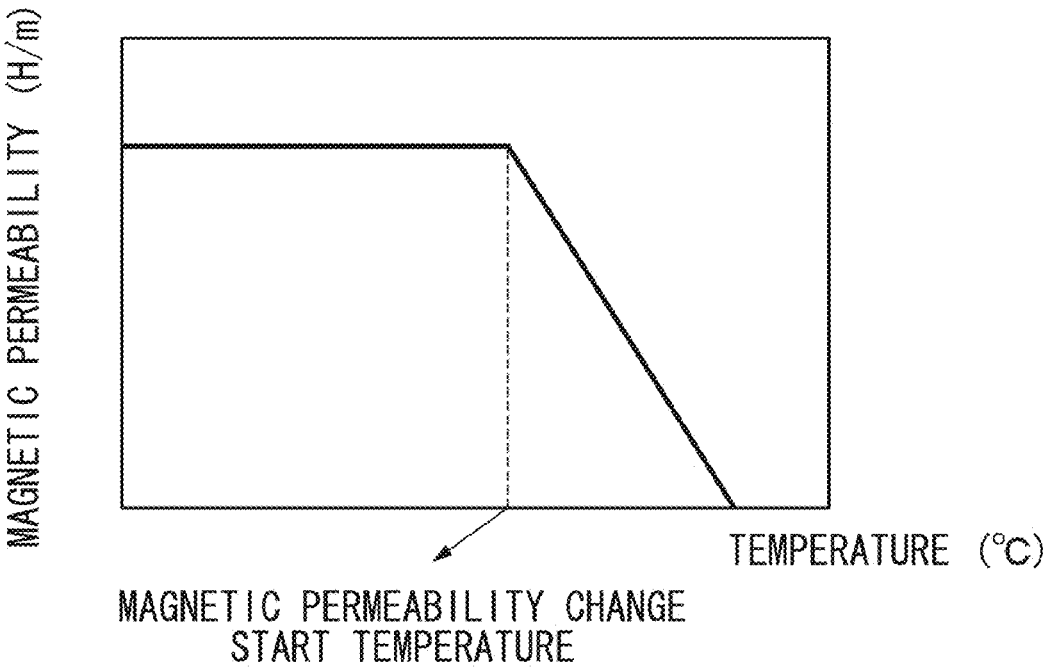
FIG. 5 is a schematic drawing showing the relationship between magnetic permeability and temperature of the temperature-sensitive magnetic member relating to the first exemplary embodiment of the present invention.

As shown in FIG. 5, the magnetic permeability change start temperature is the temperature at which the magnetic permeability (measured in accordance with JIS C2531) starts to decrease continuously, and is the point where the pass-through amount of the magnetic flux of the magnetic field starts to change. Further, the magnetic permeability change start temperature is different than the Curie point, and is preferably set to 150° C. to 230° C.

Note that, in the fixing device 100, the heating section 150 that serves as a heating device is structured by the excitation coil 110, the fixing belt 102, and the temperature-sensitive magnetic member 114 (including the convex portion 116).

On the other hand, as shown in FIG. 2A, an induction body 118 is provided at the inner side of the temperature-sensitive magnetic member 114. The induction body 118 is formed from aluminum that is a non-magnetic body, and is structured by an arc portion 118A that faces the inner peripheral surface of the temperature-sensitive magnetic member 114, and a column portion 118B that is formed integrally with the arc portion 118A. Both ends of the induction body 118 are fixed to a housing 120 of the fixing device 100. Further, the arc portion 118A of the induction body 118 is disposed in advance at a position at which, when the magnetic flux of the magnetic field H passes-through the temperature-sensitive magnetic member 114, the arc portion 118A induces the magnetic flux of the magnetic field H. By inducing magnetic flux, generation of heat due to eddy current loss that flows to the heat-generating layer 126 of the fixing belt 102 is suppressed. Other than aluminum, a non-magnetic metal having a low specific resistance and formed from copper or silver may be used as the induction body 118. The induction body 118 and the temperature-sensitive magnetic member 114 are separated by 1.0 to 5.0 mm. If the induction body 118 is too close to the temperature-sensitive magnetic member 114, the induction body 118 robs the heat of the temperature-sensitive magnetic member 114 due to heat transfer from the temperature-sensitive magnetic member 114, and the temperature-sensitive magnetic member 114 cannot correctly sense the temperature of the fixing belt 102. Therefore, it is preferable that the distance between the temperature-sensitive magnetic member 114 and the induction body 118 be greater than the distance between the fixing belt 102 and the temperature-sensitive magnetic member 114.

Flat-plate portions of supporting members 122, that are substantially L-shaped in cross-sectional view, are fixed to the steps that are formed by the arc portion 118A and the column portion 118B of the induction body 118. The peripheral direction both ends of the temperature-sensitive magnetic member 114 are fixed by adhesion or screwing or the like to curved surface portions of the supporting members 122. The temperature-sensitive magnetic member 114 is thereby supported at the induction body 118.

A pushing pad 132, that is for pushing the fixing belt 102 toward the outer side at a predetermined pressure, is fixed to and supported at the end surface of the column portion 118B of the induction body 118. Due thereto, there is no need to provide members that respectively support the induction body 118 and the pushing pad 132, and the fixing device 100 can be made to be compact. The pushing pad 132 is formed by a member that is elastic such as urethane rubber, sponge or the like. One end surface of the pushing pad 132 contacts the inner peripheral surface of the fixing belt 102 and pushes the fixing belt 102.

Figure 2C:
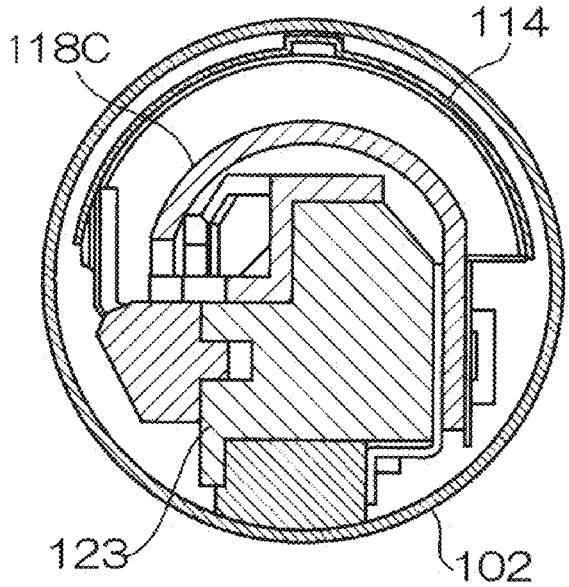
FIG. 2C is a cross-sectional view of a fixing device of another example of the present invention.
Figure 2D:
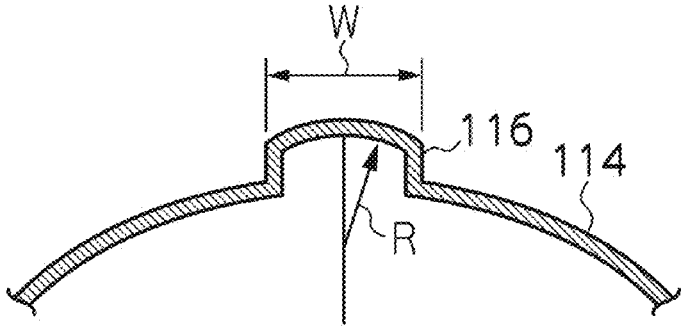
FIG. 2D is a partial sectional view of the fixing device relating to the first exemplary embodiment of the present invention.

The induction body 118 may be structured so as to be supported by a supporting body that is a separate member. In this case, for example, there may be a structure in which an induction body 118C, that is formed in the shape of a curved plate from a non-magnetic metal having a low specific resistance, is provided so as to be interposed between the temperature-sensitive magnetic member 114 and a supporting body 123, as shown in FIG. 2C. The supporting body 123 is a member for supporting the load from the pressure-applying roller 104, and preferably is rigid with little flexure.

It suffices for the thickness of the induction body 118C to be greater than or equal to at least the skin depth of the non-magnetic metal used at the induction body 118C, and to be a thickness such that, even if the temperature-sensitive magnetic member 114 becomes non-magnetic and magnetic flux passes therethrough, a magnetic path of the magnetic field H can be formed so that hardly any of the magnetic flux can pass-through the induction body 118C. In the present invention, aluminum of a thickness of 1 mm is used and is a thickness that is greater than or equal to the skin depth. Therefore, the supporting body 123 may be structured by a magnetic metal such as an inexpensive sheet metal or the like, and the degrees of freedom in selecting the material in the design increase. Because the magnetic field is soundly shielded by the induction body 118C, the supporting body 123 is hardly heated at all by electromagnetic induction, and wasteful eddy current loss can be prevented.

On the other hand, the pressure-applying roller 104, that rotates by being slave-driven by the fixing belt 102 or rotates as a main driving source in the direction of arrow B (the direction opposite the direction of arrow A) with respect to the rotation of the fixing belt 102, press-contacts the outer peripheral surface of the fixing belt 102.

The pressure-applying roller 104 is structured such that a foamed silicon rubber sponge elastic layer of a thickness of 5 mm is provided at the periphery of a core metal 106 that is formed from a metal such as aluminum or the like, and the outer side of this foamed silicon rubber sponge elastic layer is covered by a releasing layer formed from carbon-containing PFA of a thickness of 50 μm. Further, the pressure-applying roller 104 can contact or move away from the outer peripheral surface of the fixing belt 102 by a retracting mechanism in which an unillustrated bracket, that rotatably supports the pressure-applying roller 104, swings by a cam.

A thermistor 134, that measures the temperature of the inner peripheral surface of the fixing belt 102, is provided so as to contact a region at the inner side of the fixing belt 102 which region does not face the excitation coil 110 and is at the discharging side of the recording sheet P. The thermistor 134 indirectly estimates and measures the surface temperature of the fixing belt 102 by temperature-converting the resistance value that varies in accordance with the heat amount provided from the fixing belt 102. The position of contact of the thermistor 134 is a substantially central portion in the transverse direction of the fixing belt 102 (the direction of arrow X in FIG. 3), such that the measured value does not change in accordance with the magnitude of the size of the recording sheet P.

Figure 4B:
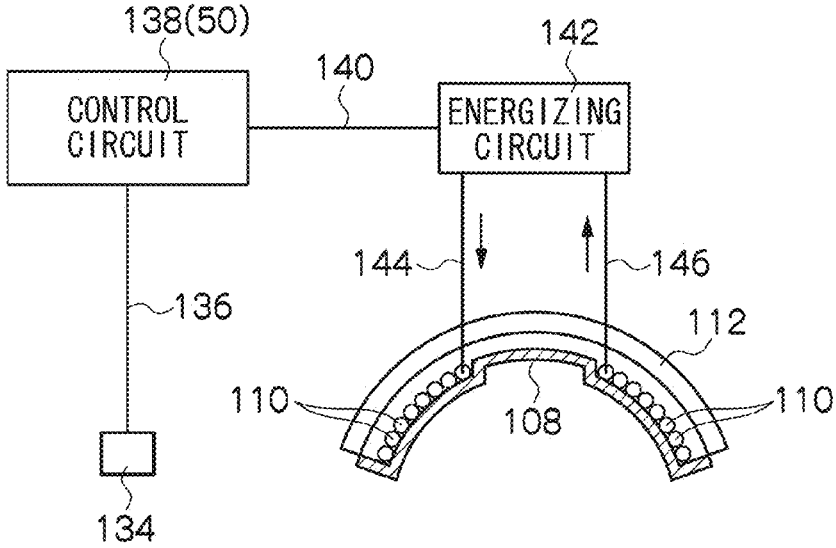
FIG. 4B is a connection diagram of a control circuit and an energizing circuit relating to the first exemplary embodiment of the present invention.

As shown in FIG. 4B, the thermistor 134 is connected, via a wire 136, to a control circuit 138 provided at the interior of the aforementioned control unit 50 (see FIG. 1). The control circuit 138 is connected to an energizing circuit 142 via a wire 140. The energizing circuit 142 is connected to the aforementioned excitation coil 110 via wires 144, 146. The energizing circuit 142 is driven or the driving thereof is stopped on the basis of electric signals sent from the control circuit 138. The energizing circuit 142 supplies (in the directions of the arrows) or stops the supply of AC current of a predetermined frequency to the excitation coil 110 via the wires 144, 146.

Here, the control circuit 138 carries out temperature conversion on the basis of an electrical amount sent from the thermistor 134, and measures the temperature of the surface of the fixing belt 102. Then, the control circuit 138 compares this measured temperature and a set fixing temperature that is stored in advance (170° C. in the present exemplary embodiment). If the measured temperature is lower than the set fixing temperature, the control circuit 138 drives the energizing circuit 142 and energizes the excitation coil 110, and causes the magnetic field H (see FIG. 2A and FIG. 2B) serving as a magnetic circuit to be generated. If the measured temperature is higher than the set fixing temperature, the control circuit 138 stops the energizing circuit 142.

A peeling member 148 is provided in a vicinity of the recording sheet P transporting direction downstream side of the contact portion (nip portion) of the fixing belt 102 and the pressure-applying roller 104. The peeling member 148 is structured by a supporting portion 148A whose one end is fixed, and a peeling sheet 148B supported at the supporting portion 148A. The distal end of the peeling sheet 148B is disposed so as to be adjacent to or contact the fixing belt 102.

Operation of the first exemplary embodiment of the present invention will be described next. First, the fixing operation of the fixing device 100 will be described.

As shown in FIG. 1 and FIG. 4B, the recording sheet P, on which the toner T has been transferred through the above-described image forming processes of the printer 10, is sent to the fixing device 100. At the fixing device 100, a driving motor (not shown) is driven by the control unit 50, and the fixing belt 102 rotates in the direction of arrow A. At this time, the energizing circuit 142 is driven on the basis of the electric signal from the control circuit 138, and AC current is supplied to the excitation coil 110.

When AC current is supplied to the excitation coil 110, generation and extinction of the magnetic field H serving as a magnetic circuit are repeated at the periphery of the excitation coil 110. Then, when the magnetic field H traverses the heat-generating layer 126 of the fixing belt 102, eddy current is generated at the heat-generating layer 126 such that a magnetic field that impedes changes in the magnetic field H arises.

The heat-generating layer 126 generates heat in proportion to the magnitudes of the skin resistance of the heat-generating layer 126 and the eddy current flowing through the heat-generating layer 126, and the fixing belt 102 is heated thereby. The temperature of the surface of the fixing belt 102 is sensed at the thermistor 134, and if it has not reached the set fixing temperature of 170° C., the control circuit 138 drives and controls the energizing circuit 142 such that AC current of a predetermined frequency is supplied to the excitation coil 110. Further, in a case in which the temperature of the surface of the fixing belt 102 has reached the set fixing temperature, the control circuit 138 stops control of the energizing circuit 142.

At the stage when the fixing belt 102 reaches the set fixing temperature or higher, the control unit 50 operates the retracting mechanism and makes the pressure-applying roller 104 contact the fixing belt 102. Then, the pressure-applying roller 104 is slave-rotated by the fixing belt 102 that rotates, and rotates in the direction of arrow B. In a case in which driving rigidity that makes the fixing belt 102 serves as the driving source is insufficient, a form of driving may be utilized in which the pressure-applying roller 104 becomes the main driving source, and from after the time of application of pressure, the fixing belt 102 is slave-rotated by the pressure-applying roller 104. In this case, the following structure suffices: the fixing belt 102 and the pressure-applying roller 104 are both made drivable simultaneously from an unillustrated drive source motor by using plural gear trains, a one-way clutch is provided at the driving side of the fixing belt 102, and the fixing belt 102 is rotated at a speed slower than the pressure-applying roller 104, and from the time of application of pressure and thereafter, the pressure-applying roller 104 side that has a rotational speed faster than that becomes the main drive source, and the fixing belt 102 is slave-driven due to the effects of the one-way clutch.

Next, the recording sheet P that is sent into the fixing device 100 is heated and pressed by the fixing belt 102 that has become the predetermined set fixing temperature (170° C.) and the pressure-applying roller 104, such that the toner image is fixed on the surface of the recording sheet P. The recording sheet P, that is ejected from the fixing device 100, is ejected to the tray 38 by the sheet transporting rollers 36.

Next, operation of the temperature-sensitive magnetic member 114 will be described.

Figure 6A:
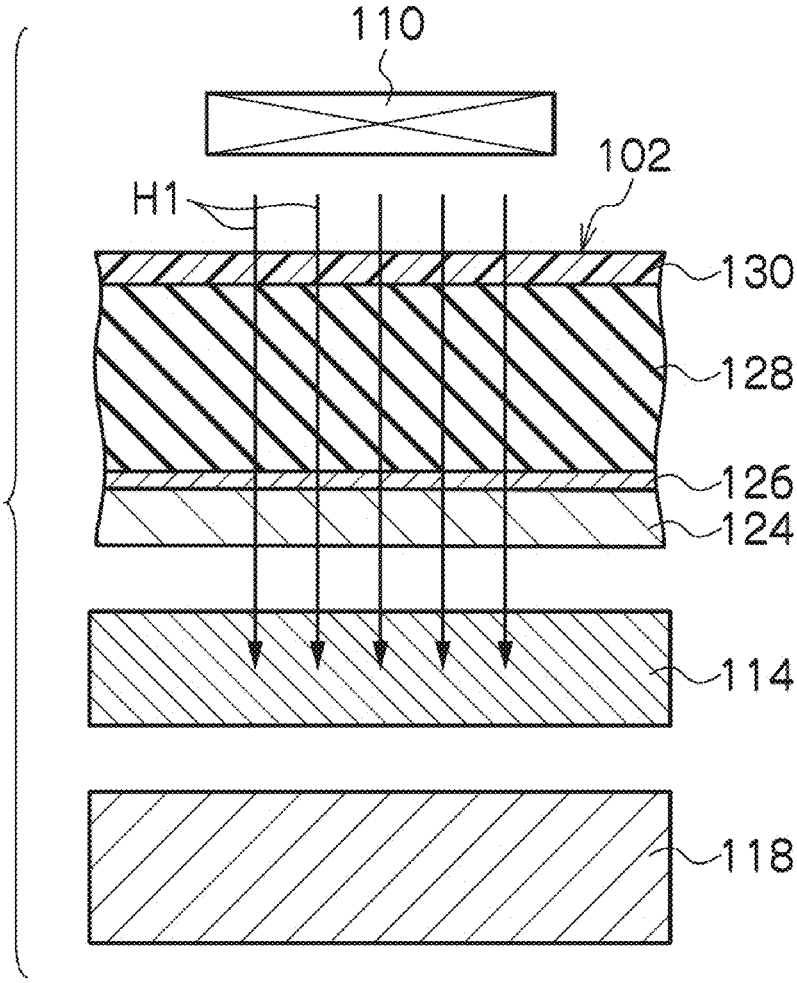
FIG. 6A and FIG. 6B are schematic drawings showing states in which a magnetic field passes-through the fixing belt and the temperature-sensitive magnetic member relating to the first exemplary embodiment of the present invention.
Figure 6B:
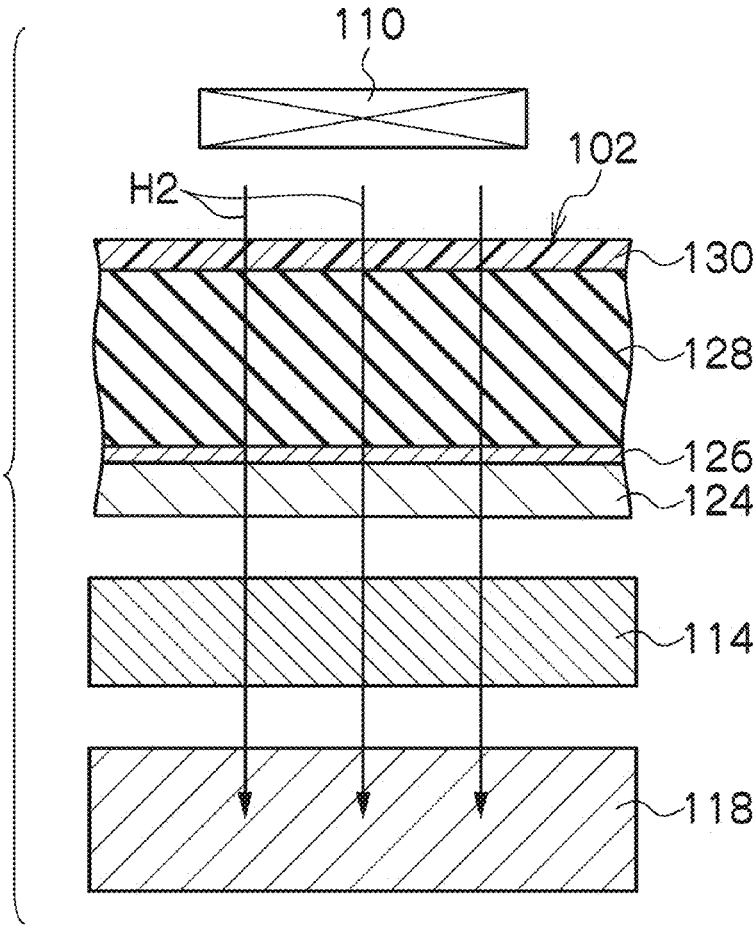

FIG. 6A shows a case in which the temperature of the temperature-sensitive magnetic member 114 is less than or equal to the magnetic permeability change start temperature. FIG. 6B shows a case in which the temperature of the temperature-sensitive magnetic member 114 is greater than or equal to the magnetic permeability change start temperature.

As shown in FIG. 6A, in a case in which the temperature of the temperature-sensitive magnetic member 114 is less than or equal to the magnetic permeability change start temperature, the temperature-sensitive magnetic member 114 is a strong magnetic body, and therefore, a magnetic field H1 that has passed-through the fixing belt 102 penetrates into the temperature-sensitive magnetic member 114 and forms a closed magnetic path, and the magnetic field H1 is strengthened. Due thereto, a sufficient heat generation amount of the heat-generating layer 126 of the fixing belt 102 is obtained, and the temperature is raised to the predetermined set fixing temperature.

On the other hand, as shown in FIG. 6B, in a case in which the temperature of the temperature-sensitive magnetic member 114 is greater than or equal to the magnetic permeability change start temperature, the magnetic permeability of the temperature-sensitive magnetic member 114 decreases. Therefore, a magnetic field H2 that has passed-through the fixing belt 102 also passes-through the temperature-sensitive magnetic member 114 and heads toward the induction body 118. At this time, the magnetic flux density decreases and the magnetic field H2 weakens, and the magnetic field H2 can no longer easily pass-through and form a closed magnetic path. The magnetic flux reaches the induction body 118, and more of the eddy current flows to the induction body 118 than to the heat-generating layer 126. Therefore, the heat generation amount of the heat-generating layer 126 decreases. Due thereto, the proportion of the rise in temperature of the fixing belt 102 decreases.

Figure 7A:
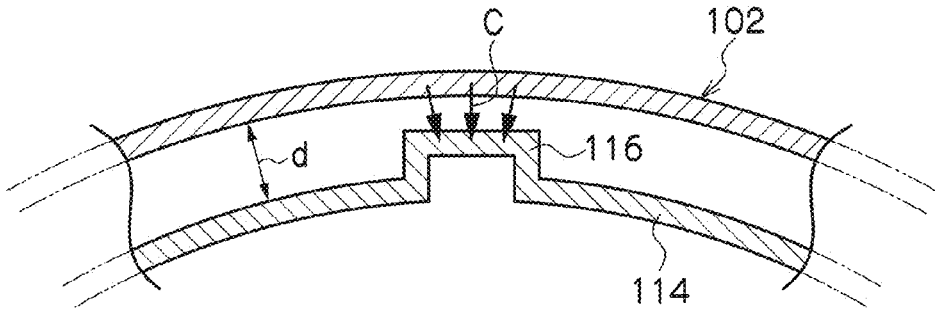
FIG. 7A is a partial sectional view of the fixing belt and the temperature-sensitive magnetic member relating to the first exemplary embodiment of the present invention.

Here, as shown in FIG. 7A, the temperature-sensitive magnetic member 114 faces the fixing belt 102 with a gap of distance d therebetween at the arcuate region other than the convex portion 116. Therefore, when the temperature of the fixing belt 102 rises, it is difficult for the heat that is generated at the heat-generating layer 126 to be transferred to the temperature-sensitive magnetic member 114. Due thereto, it is difficult for the temperature-sensitive magnetic member 114 to rob heat from the fixing belt 102, and the temperature of the fixing belt 102 can be raised quickly in a short time period.

Because the temperature-sensitive magnetic member 114 is metal, it can be thought to be self-heat-generating due to the working of the electromagnetic induction of the magnetic field H. The temperature-sensitive magnetic member 114 itself is preferably a "non-heat-generating body" that, to the extent possible, is not made to generate heat due to the working of a magnetic field. At the time of heating the fixing belt 102 by the working of electromagnetic induction, the magnetic flux due to the electromagnetic induction similarly acts on the temperature-sensitive magnetic member 114 as well. Therefore, if the self-heat-generation due to eddy current loss is great, there are cases in which the temperature rises and unintendedly reaches the magnetic permeability change start temperature, and the effect of suppressing a rise in temperature is exhibited when not necessary. Because the temperature-sensitive magnetic member 114 is a member needed to keep in check the temperature of the fixing belt 102, the unintended rise in temperature of itself due to self-heat-generation must be kept as small as possible. With respect to self-heat-generation in particular, it is important to greatly suppress the effects of eddy current loss. In the present invention, the self-heat-generation is effectively suppressed by a structure that cuts-off the path of the eddy current.

On the other hand, at the convex portion 116 of the temperature-sensitive magnetic member 114, because the fixing belt 102 and the temperature-sensitive magnetic member 114 are adjacent, heat is transferred by radiation (arrows C) and heat transfer from the high-temperature fixing belt 102. The heat, that is transferred to the convex portion 116 that is nearest to the fixing belt 102, is conducted from the convex portion 116 to the temperature-sensitive magnetic member 114. If there are places where the temperature of the temperature-sensitive magnetic member 114 exceeds the magnetic permeability change start temperature, the magnetic permeability decreases and magnetic flux is passed-through, and therefore, the magnetic field H weakens, the heat generation amount of the heat-generating layer 126 decreases, and a rise in temperature of the fixing belt 102 is suppressed. Due thereto, a rise in temperature, that is more than needed, of the fixing belt 102 is suppressed.

In this way, the convex portion is, in a way, a sensing portion for sensing the temperature of the fixing belt 102 while not robbing too much of the heat of the fixing belt 102. By providing the gap at the region of the temperature-sensitive magnetic member 114 other than the convex portion 116, it is made as difficult as possible for the temperature-sensitive magnetic member 114 to rob heat from the fixing belt 102 at the time of warm-up. The convex portion 116 is disposed at a position such that, at the time when the temperature rises such as when sheets are passed through in continuation or the like, the temperature of the fixing belt 102 can be reliably sensed through the convex portion 116.

On the other hand, even when the temperature-sensitive magnetic member 114 is designed as a "non-heat-generating body" that, as much as possible, is not made to generate heat due to the working of a magnetic field, it can be thought that there may be cases in which, at the time when sheets are passed through in continuation, the temperature of the temperature-sensitive magnetic member 114 becomes higher than the temperature of the fixing belt 102 due to the self-heat-generation of the temperature-sensitive magnetic member 114. In such cases, heat is transferred through the convex portion 116 from the temperature-sensitive magnetic member 114 side toward the fixing belt 102 side, and therefore, excessive heat that is generated by the self-heat-generation of the temperature-sensitive magnetic member 114 is discharged toward the fixing belt 102 side. Namely, due to the movement of heat through the convex portion 116, the heat energy of the self-heat-generation of the temperature-sensitive magnetic member 114 is utilized effectively at the fixing belt 102 side, and an excessive rise in temperature of the temperature-sensitive magnetic member 114 is suppressed.

Note that, at times of contacting the pressure-applying roller 104 and at times of rotating, the fixing belt 102 is deformed transiently. Even if the fixing belt 102 contacts the temperature-sensitive magnetic member 114, because there is the convex portion 116, a gap is formed between the fixing belt 102 and the temperature-sensitive magnetic member 114 in a vicinity of the convex portion 116. Due thereto, the entire fixing belt 102 is prevented from contacting the temperature-sensitive magnetic member 114.

In order to increase the heat transmitting efficiency between the fixing belt 102 and the temperature-sensitive magnetic member 114 at times when sheets are passed through in continuation, it is better for the convex portion 116 to contact the fixing belt 102. However, in order for the convex portion 116 to not rob too much heat from the fixing belt 102 at the time of warm-up, it is preferable that the convex portion 116 be provided so as to correspond to an angle of less than or equal to 25% of the temperature-sensitive magnetic member 114. Namely, in a case in which the temperature-sensitive magnetic member 114 corresponds to an angular portion of 160° with respect to the perfect circle reference center of the fixing belt 102, it is preferable that the convex portion 116 be disposed so as to correspond to an angular portion that is less than or equal to 40°. Further, when considering effects such as scratching of the fixing belt 102 and the like, it is preferable that the convex portion 116 be provided so as to correspond to an angle of greater than or equal to 5% of the temperature-sensitive magnetic member 114, and it is preferable that the convex portion 116 have a curved surface of a radius of curvature that is greater than or equal to 1 mm and is less than or equal to the radius of curvature of the fixing belt 102.

Further, the position of the convex portion 116 of the temperature-sensitive magnetic member 114 is disposed at a position that does not face the excitation coil 110 (the hole portion at the center of the coil or a place extending further than the excitation coil 110). Therefore, the gap between the fixing belt 102 and the temperature-sensitive magnetic member 114 at the region facing the excitation coil 110 is substantially constant. Due thereto, the temperature distribution of the heat-generating region of the fixing belt 102 can be maintained substantially uniform.

Because the convex portion 116 extends so as to have the same height in the longitudinal direction of the temperature-sensitive magnetic member 114, the gap between the temperature-sensitive magnetic member 114 and the fixing belt 102 at the region where the convex portion 116 is provided is substantially uniform, and the temperature distribution in the transverse direction of the fixing belt 102 is substantially uniform.

Figure 7B:
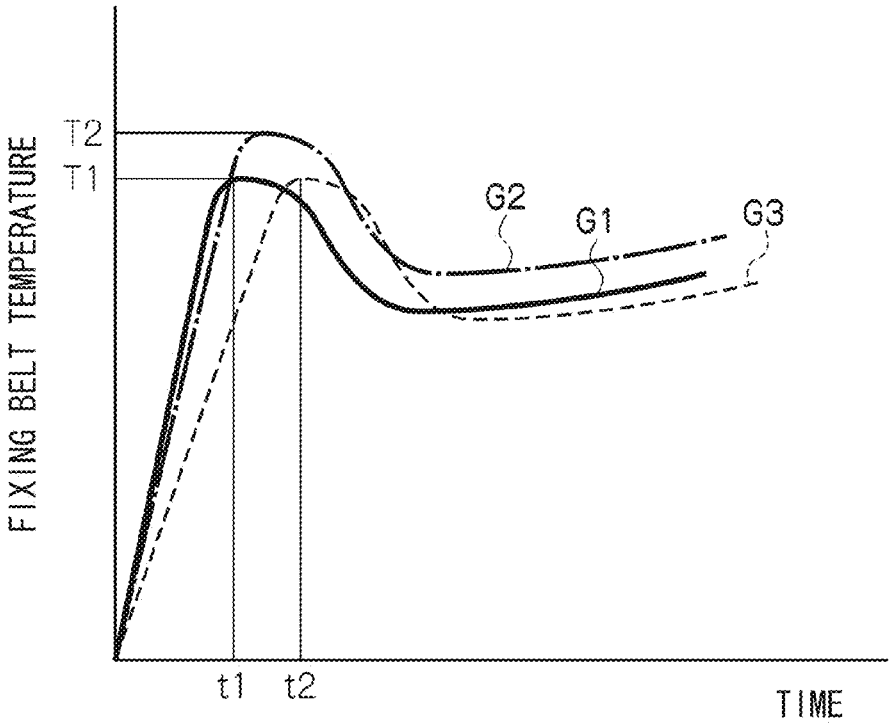
FIG. 7B is a graph showing the relationship between time and fixing belt temperature of comparative examples and the fixing device relating to the first exemplary embodiment of the present invention.

The relationship between time (the time that has elapsed from start-up) and the temperature of the fixing belt 102 is shown in FIG. 7B. Graph G1 is the time-temperature curve of the fixing device 100 of the present exemplary embodiment. As comparative example 1, graph G2 is the time-temperature curve at the time when the temperature-sensitive magnetic member 114 that does not have the convex portion 116 is disposed at substantially the same position as the temperature-sensitive magnetic member 114 of the present exemplary embodiment. As comparative example 2, graph G3 is the time-temperature curve at the time when the temperature-sensitive magnetic member 114 that does not have the convex portion 116 is made to contact the inner peripheral surface of the fixing belt 102.

As can be understood by comparing graph G1 and graph G2, in the structure that does not have the convex portion 116, it is difficult for the heat of the fixing belt 102 to be transferred to the temperature-sensitive magnetic member 114, the arrival of the temperature of the temperature-sensitive magnetic member 114 at the magnetic permeability change start point is delayed, and the temperature of the fixing belt 102 overshoots and rises to temperature T2. On the other hand, in a structure having the convex portion 116 such as the present exemplary embodiment, rise in temperature is suppressed at temperature T1.

Further, as can be understood from comparing graph G1 and graph G3, in the structure in which the temperature-sensitive magnetic member 114 without the convex portion 116 is made to contact the fixing belt 102, the heat of the fixing belt 102 is robbed by the temperature-sensitive magnetic member 114 at the time of the rise in temperature of the fixing belt 102. Therefore, the temperature rising speed decreases, and the time until the predetermined set temperature (T1) is reached is t2. On the other hand, in a structure in which the fixing belt 102 and the temperature-sensitive magnetic member 114 are disposed with a gap therebetween such as in the present exemplary embodiment, the time to temperature T1 is t1 (<t2), and the temperature is raised in a short time period.

Figure 8A:
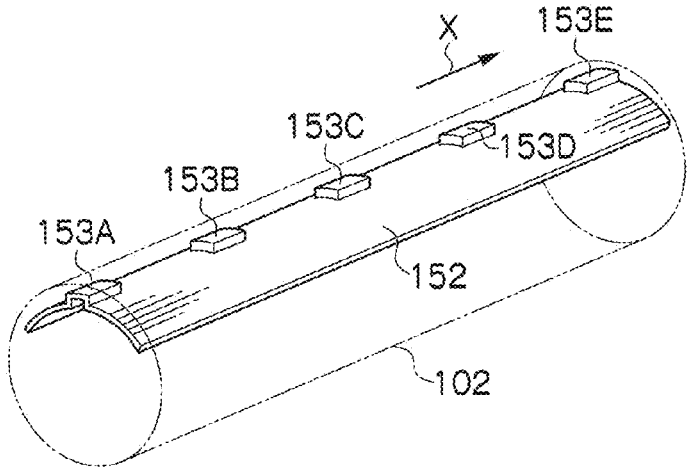
FIGS. 8A through 8C are perspective views showing other examples of the temperature-sensitive magnetic member of the first exemplary embodiment of the present invention.
Figure 8B:
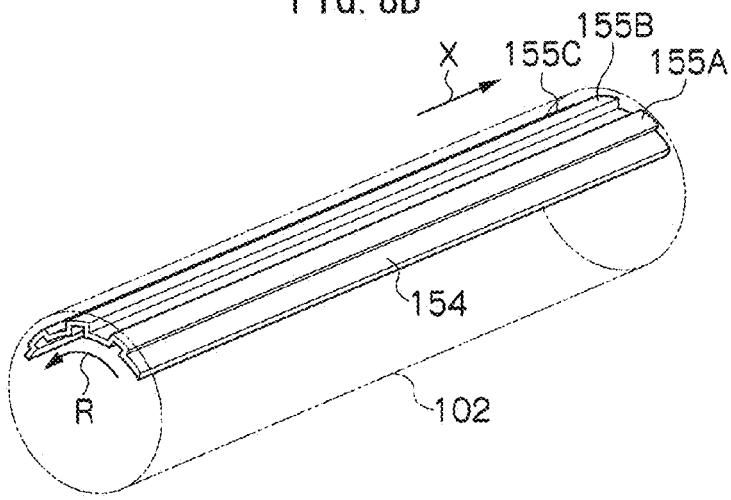
Figure 8C:
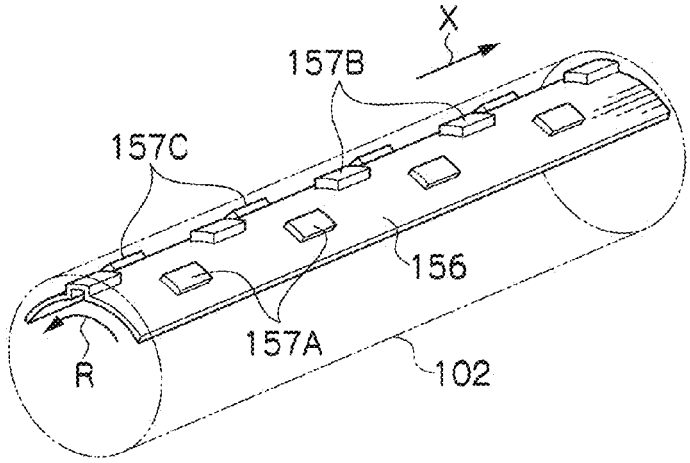

Note that, for example, temperature-sensitive magnetic members 152, 154, 156 that are shown in FIG. 8A through FIG. 8C may be used as other examples of the temperature-sensitive magnetic member 114 of the first exemplary embodiment of the present invention.

The temperature-sensitive magnetic member 152 is a similar material as the temperature-sensitive magnetic member 114, and is structured such that convex portions 153A, 153B, 153C, 153D, 153E are provided at uniform intervals along the longitudinal direction (the direction of arrow X). As is the case with the above-described convex portion 116 at one place, the convex portion 116 may be set close to the fixing belt 102 along the entire longitudinal direction. However, in a case in which, for example, the inner diameter of the fixing belt 102 differs at the central portion and the both end portions, the gap between the fixing belt 102 and the temperature-sensitive magnetic member 114 can be made to be uniform by making the convex portions 153A, 153E be different heights than the convex portions 153B through 153D.

The temperature-sensitive magnetic member 154 is a similar material as the temperature-sensitive magnetic member 114, and is structured such that convex portions 155A, 155B, 155C that extend along the longitudinal direction (the direction of arrow X) are provided at uniform intervals along the transverse direction (the direction of arrow R). In this way, owing to the plural convex portions, the gap between the temperature-sensitive magnetic member 154 and the fixing belt 102 at the transverse direction central portion and both end portions of the temperature-sensitive magnetic member 154 can be made to be uniform, and temperature differences in the transverse direction of the temperature-sensitive magnetic member 154 can be made to be small.

The temperature-sensitive magnetic member 156 is a similar material as the temperature-sensitive magnetic member 114, and is structured such that plural convex portions 157A, 157B, 157C are provided at uniform intervals along the longitudinal direction (the direction of arrow X), and further, in a staggered form along the transverse direction. In this way, a structure that combines the temperature-sensitive magnetic member 152 and the temperature-sensitive magnetic member 154 may be used.

Next, a second exemplary embodiment of the heating device, fixing device and image forming device of the present invention will be described on the basis of the drawings. Note that parts that are basically the same as those of the above-described first exemplary embodiment are denoted by the same reference numerals as in the first exemplary embodiment and description thereof is omitted.

Figure 9:
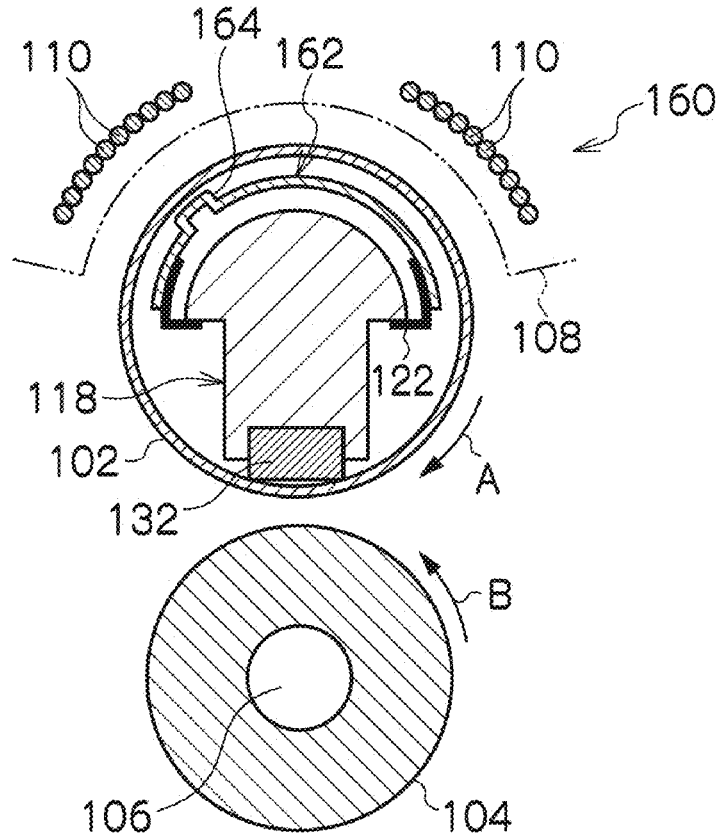
FIG. 9 is a cross-sectional view of a fixing device relating to a second exemplary embodiment of the present invention.

A fixing device 160 serving as the second exemplary embodiment is shown in FIG. 9. Instead of the temperature-sensitive magnetic member 114 of the above-described fixing device 100, the fixing device 160 has a temperature-sensitive magnetic member 162.

The temperature-sensitive magnetic member 162 is disposed so as to face the excitation coil 110. Further, a convex portion 164 projects-out toward the fixing belt 102 at the arcuate surface at the cross-sectional left side of the temperature-sensitive magnetic member 162 (the rotating direction upstream side of the fixing belt 102), in a direction that is inclined by an angle of substantially 45° from the center of curvature of the arc. The height of the convex portion 164 (the amount of projection from the arcuate surface) is 0.5 mm. The convex portion 164 is formed by drawing processing, and the thickness of the temperature-sensitive magnetic member 162 at the convex portion 164 is a thickness that is near to the thickness of the other arcuate surface.

Note that the convex portion 164 is disposed at a position at which, in a state in which there is no temperature-sensitive magnetic member 162 in advance, the amount of deformation from a perfect circle of the fixing belt 102 at the time when the press-contact roller 104 is made to contact the fixing belt 102 by the retracting mechanism and rotates, is the largest (here, the position at which the fixing belt 102 deforms the most inwardly). However, the position at which the convex portion 164 is set is not limited to a 45° position, and is set appropriately in accordance with the deformation of the fixing belt 102.

Operation of the second exemplary embodiment of the present invention will be described next.

Figure 10A:
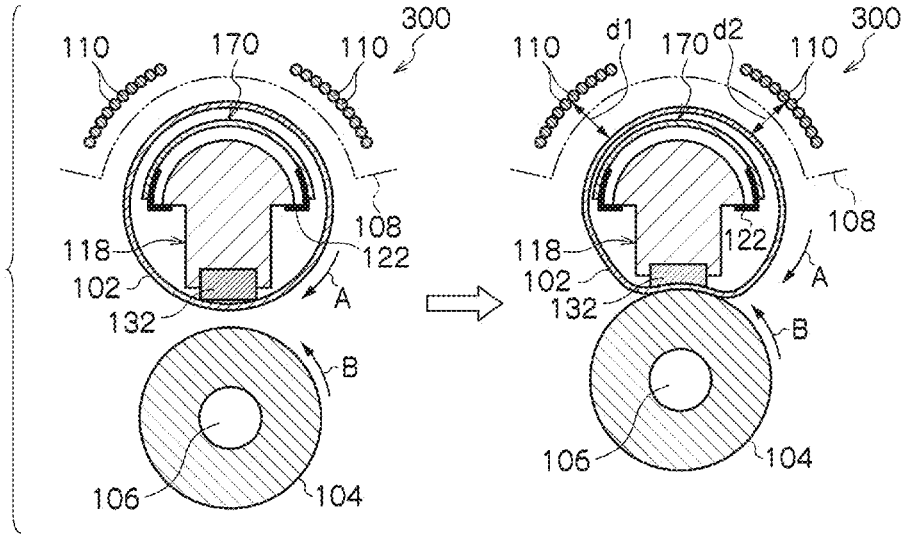
FIG. 10A is a cross-sectional view showing a deformed state of a fixing belt in a fixing device of a comparative example.

FIG. 10A is a schematic drawing of a fixing device 300 that is a comparative example of the present invention and at which is provided a temperature-sensitive magnetic member 170 that does not have a convex portion. Note that, with regard to this comparative example as well, parts that are basically the same as the exemplary embodiments of the present invention are denoted by the same reference numerals and description thereof is omitted.

In the fixing device 300 of the comparative example, when the fixing belt 102 is driven by a motor and rotates and the pressure-applying roller 104 contacts the fixing belt 102 due to the retracting mechanism, the fixing belt 102 tightly contacts the pushing pad 132 at the contact portion with the pressure-applying roller 104. Therefore, the rotation direction (arrow A direction) upstream side (left side in the drawing) of the fixing belt 102 is pulled, and the downstream side (right side in the drawing) slackens.

Due thereto, at the rotating direction upstream side, a distance d1 of the gap between the excitation coil 110 and the fixing belt 102 becomes large, and, at the rotating direction downstream side, a distance d2 of the gap between the excitation coil 110 and the fixing belt 102 becomes small. Note that, at the rotating direction upstream side, the gap between the fixing belt 102 and the temperature-sensitive magnetic member 170 becomes small, and, at the rotating direction downstream side, the gap between the fixing belt 102 and the temperature-sensitive magnetic member 170 becomes large.

In this way, at the fixing device 300 of the comparative example, distance d1>distance d2. Therefore, the magnetic flux density of the magnetic field H that acts on the heat-generating layer 126 of the fixing belt 102 differs, and differences arise in the heat generation amount of the heat-generating layer 126. Due thereto, the temperature distribution of the fixing belt 102 varies in the peripheral direction. Further, if the distance d1 becomes small, the fixing belt 102 and the temperature-sensitive magnetic member 170 contact over a wide range, the heat of the fixing belt 102 is transferred to the temperature-sensitive magnetic member 170, and it becomes difficult to raise the temperature of the fixing belt 102.

Figure 10B:
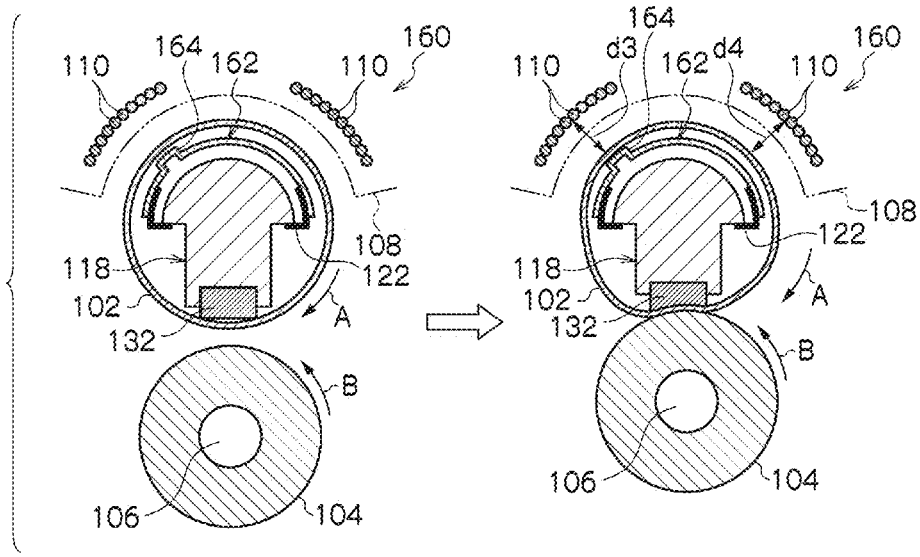
FIG. 10B is a cross-sectional view showing a deformed state of a fixing belt in the fixing device relating to the second exemplary embodiment of the present invention.

On the other hand, as shown in FIG. 10B, in the fixing device 160 of the present invention, when the fixing belt 102 is driven by a motor and rotates and the pressure-applying roller 104 contacts the fixing belt 102 due to the retracting mechanism, in order for the fixing belt 102 to drive the pressure-applying roller 104, the rotating direction upstream side of the fixing belt 102 is pulled, and the downstream side starts to slacken. At this time, the inner peripheral surface of the fixing belt 102 contacts the convex portion 164 of the temperature-sensitive magnetic member 162, and inward deformation of the fixing belt 102 at the rotating direction upstream side is restricted.

Due thereto, the difference between a distance d3 of the gap between the excitation coil 110 and the fixing belt 102 at the rotating direction upstream side, and a distance d4 of the gap between the excitation coil 110 and the fixing belt 102 at the rotating direction downstream side, is small. Further, at the rotating direction upstream side and downstream side, the gap between the fixing belt 102 and the temperature-sensitive magnetic member 162 is a gap of the same extent.

In this way, at the fixing device 160 of the present exemplary embodiment, because the difference between distance d3 and distance d4 is small, the magnetic flux density of the magnetic field H that acts on the heat-generating layer 126 of the fixing belt 102 is substantially the same, and the heat generation amount of the heat-generating layer 126 is the same extent. Due thereto, the temperature distribution of the fixing belt 102 is substantially the same extent in the peripheral direction.

Further, owing to the convex portion 164, the fixing belt 102 and the temperature-sensitive magnetic member 162 do not contact over a wide range, and it is difficult for the heat of the fixing belt 102 to be transferred to the temperature-sensitive magnetic member 162. Therefore, raising of the temperature of the fixing belt 102 is carried out in a short time period. Note that, in order to reduce the frictional force due to contact of the fixing belt 102 and the convex portion 164, a fluorine resin may be coated on the surface of the convex portion 164.

Next, a third exemplary embodiment of the heating device, fixing device and image forming device of the present invention will be described on the basis of the drawings. Note that parts that are basically the same as those of the above-described first exemplary embodiment are denoted by the same reference numerals as in the first exemplary embodiment and description thereof is omitted.

Figure 11A:
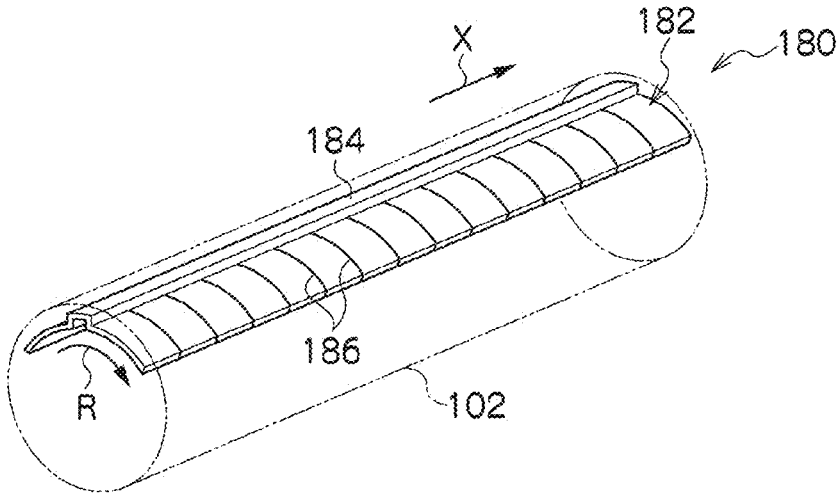
FIG. 11A and FIG. 11B are a perspective view and a plan view of a temperature-sensitive magnetic member relating to a third exemplary embodiment of the present invention.
Figure 11B:
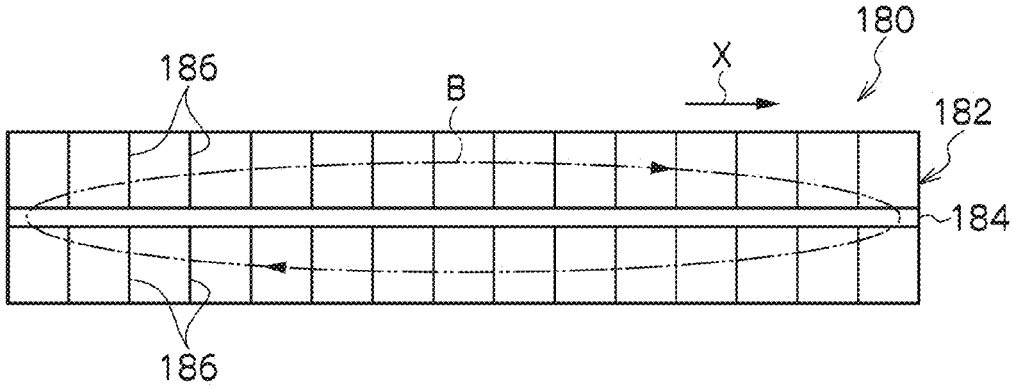

A fixing device 180 serving as the third exemplary embodiment is shown in FIG. 11A and FIG. 11B. Instead of the temperature-sensitive magnetic member 114 of the above-described fixing device 100, the fixing device 180 has a temperature-sensitive magnetic member 182.

The temperature-sensitive magnetic member 182 is disposed so as to face the excitation coil 110. A convex portion 184, that projects-out in the radial direction (the direction from the temperature-sensitive magnetic member 182 toward the fixing belt 102) and extends long in the longitudinal direction (the direction of arrow X), is provided at the position of the temperature-sensitive magnetic member 182 which position faces the convex portion 108A of the bobbin 108 (a position that does not face the excitation coil 110).

The height (the amount of projection from the arcuate surface) of the convex portion 184 of the temperature-sensitive magnetic member 182 is 0.5 mm. The distance between the top surface of the convex portion 184 and the inner peripheral surface of the fixing belt 102 is set to be 0.5 to 1 mm. Note that the convex portion 184 is formed by drawing processing, and the thickness at the convex portion 184 is a thickness that is near to the thickness of the other arcuate surface.

Slits (cuts), that are eddy current cutting-off structures that cut-off the path of the eddy current for suppressing self-heat-generation of the temperature-sensitive magnetic member 182, are provided in the arcuate region of the temperature-sensitive magnetic member 182 other than the convex portion 184, so as to form slits 186 that are rectilinear from the convex portion 184 toward the both transverse direction (peripheral direction) outer sides. The slits 186 are provided at plural places at uniform intervals in the longitudinal direction of the temperature-sensitive magnetic member 182. Note that the direction of formation of the slits 186 is a direction intersecting the direction (the direction of arrow B in FIG. 11B) in which the eddy current that is generated at the temperature-sensitive magnetic member 182 flows. The structure that cuts-off the path of the eddy current may divide the temperature-sensitive magnetic member 182 into small pieces so as to form small piece groups. In this case, the distance of each small piece to the fixing belt 102 can be changed in the axial direction. For example, in a case in which a thermostat sensor or the like is disposed at the inner portion of the fixing belt 102 and a place where the magnetic flux density is weak exists in the axial direction, the temperature of the portion of the fixing belt 102 corresponding to that place falls. However, by making the small piece of the temperature-sensitive magnetic member 182 at the position corresponding to that place be slightly near to the fixing belt 102 side, the decrease in the magnetic flux density can be compensated for, and therefore, a decrease in the temperature of the fixing belt 102 can be prevented.

Operation of the third exemplary embodiment of the present invention will be described next.

As shown in FIG. 11A and FIG. 11B, when the magnetic field H is generated due to energization of the excitation coil 110 (refer to FIG. 2A and FIG. 2B), the magnetic field H passes-through the fixing belt 102 and penetrates into the temperature-sensitive magnetic member 182. Here, because the temperature-sensitive magnetic member 182 is metal, eddy current B starts to flow so as to generate a magnetic field that hinders the magnetic field H. However, because the path is cut-off by the plural slits 186, flowing of the eddy current B at the entire temperature-sensitive magnetic member 182 is eliminated. Further, even if the eddy current B were to flow, the current value would be extremely small because of the closed loops within the small regions partitioned by the slits 186. Due thereto, self-heat-generation of the temperature-sensitive magnetic member 182 is suppressed, and a rise in temperature of the fixing belt 102 to greater than or equal to the set temperature is suppressed.

Next, a fourth exemplary embodiment of the heating device of the present invention will be described on the basis of the drawings. Note that parts that are basically the same as those of the above-described first exemplary embodiment are denoted by the same reference numerals as in the first exemplary embodiment and description thereof is omitted.

Figure 12:
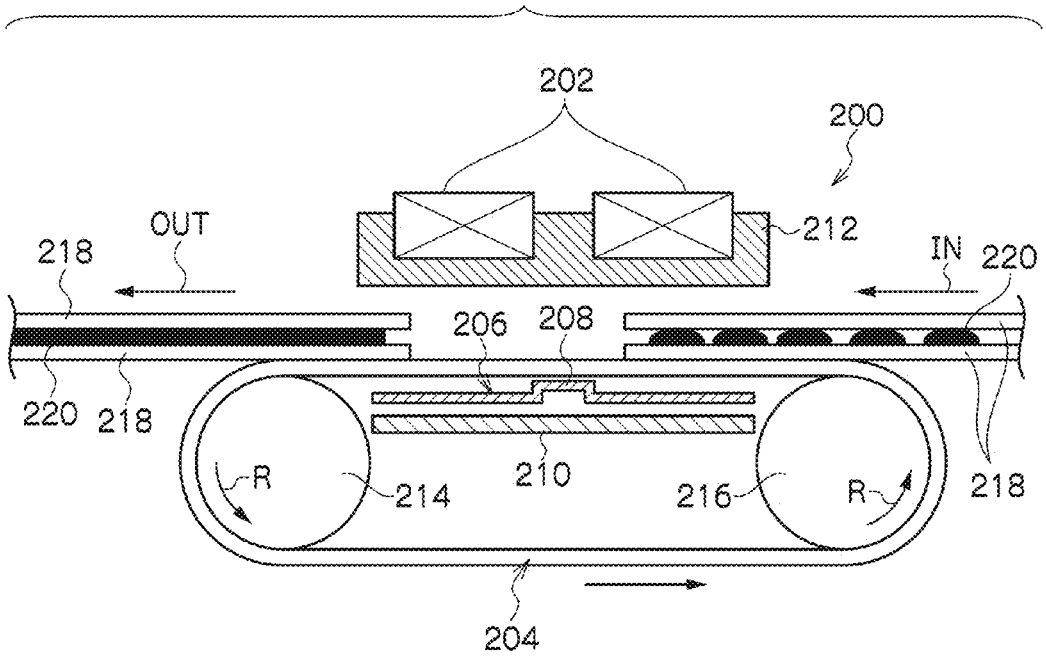
FIG. 12 is a cross-sectional view of a heating device relating to a fourth exemplary embodiment of the present invention.

A heating device 200 is shown in FIG. 12. The heating device 200 has: an excitation coil 202 that is energized by an unillustrated energizing unit and generates a magnetic field; a heating belt 204 disposed so as to face the excitation coil 202, and formed from a material and a layer structure that are similar to those of the above-described fixing belt 102 (see FIG. 2A through FIG. 2C); and a temperature-sensitive magnetic member 206 formed from a material similar to that of the above-described temperature-sensitive magnetic member 114 (see FIG. 2A through FIG. 2C), and disposed at the inner side of the heating belt 204 in a non-contact state.

The excitation coil 202 is adhered and fixed to a resin bobbin 212 and is supported thereby. Further, the heating belt 204 is stretched around a pair of rollers 214, 216 that are rotatable, and at which the surface of a non-magnetic SUS (stainless steel) core metal is covered by a silicon rubber layer of a predetermined surface roughness (surface roughness such that they can move the heating belt 204).

An unillustrated driving mechanism such as gears, a motor and the like is connected to one of the rollers 214, 216. When the rollers 214, 216 rotate in the direction of arrow R due to the driving mechanism, the heating belt 204 moves in the direction of the arrow. Note that the heating belt 204 may be formed substantially in the shape of a cylindrical tube, and gears may be adhered and fixed to the end portions thereof such that the heating belt 204 is driven directly.

The temperature-sensitive magnetic member 206 is formed in the shape of a flat plate. A convex portion 208 is provided toward the heating belt 204 at a region of the temperature-sensitive magnetic member 206 which region does not face the excitation coil 202. Further, an induction body 210 is provided in a non-contact state at the side of the temperature-sensitive magnetic member 206 opposite the side at which the heating belt 204 is located. The induction body 210 is shaped as a flat plate, and is structured of the same material as the above-described induction body 118 (see FIG. 2A through FIG. 2C).

Operation of the fourth exemplary embodiment of the present invention will be described next. Note that, in the present exemplary embodiment, a case in which the heating device 200 is used in fusing and adhering will be described.

First, the excitation coil 202 is energized by the unillustrated energizing unit, and a magnetic field is generated at the periphery of the excitation coil 202. In the same way as the above-described fixing belt 102, the heating belt 204 generates heat due to the working of the electromagnetic induction by this magnetic field.

Here, because the temperature-sensitive magnetic member 206 faces the heating belt 204 with a gap therebetween at regions other than the convex portion 208, it is difficult for the heat that is generated at the time of raising the temperature of the heating belt 204 to be transferred to the temperature-sensitive magnetic member 206. Due thereto, it is difficult for temperature-sensitive magnetic member 206 to rob heat from the heating belt 204, and the temperature of the heating belt 204 rises rapidly in a short time.

Because the temperature-sensitive magnetic member 206 is metal, it can be thought to slightly self-heat-generate due to the working of the electromagnetic induction of the magnetic field H. However, it is difficult for heat to be transferred because there is the gap, and therefore, the temperature-sensitive magnetic member 206 does not affect the heating of the heating belt 204. Further, due to the facts that it is difficult for heat to be transferred and that the self-heat-generation is slight, a sudden rise in temperature of the temperature-sensitive magnetic member 206 is suppressed. Due thereto, manifesting of the temperature suppressing effect of the temperature-sensitive magnetic member 206 at times when it is not needed is suppressed. Note that the heat generation amount at the temperature-sensitive magnetic member 206 is less than or equal to one-half of the heat generation amount at the heating belt 204.

On the other hand, at the convex portion 208 of the temperature-sensitive magnetic member 206, the temperature-sensitive magnetic member 206 is adjacent to the fixing belt 204, and therefore, the radiation heat from the high-temperature fixing belt 204 is transferred to the convex portion 208. The heat that is transferred to the convex portion 208 is conducted from the convex portion 208 to the entire temperature-sensitive magnetic member 206. Further, if the temperature of the temperature-sensitive magnetic member 206 exceeds the magnetic permeability change start temperature, the magnetic permeability decreases and the magnetic flux is passed-through, and therefore, the magnetic field weakens. The heat generation amount of the heating belt 204 decreases, and the rise in temperature is suppressed. Due thereto, a rise in temperature of the heating belt 204 that is greater than needed is suppressed.

Next, at the heating device 200, the rollers 214, 216 are driven and rotate, and the heating belt 204 starts to move in the direction of the arrow. A pair of resin plates 218 are thereby transported to the heating device 200 (arrow IN). Note that an adhesive 220, that is a solid resin and fuses at a predetermined temperature, is sandwiched in advance between the pair of plates 218.

Next, the adhesive 220 is fused by the generation of heat of the heating belt 204, and spreads between the pair of plates 218. Due to the movement of the heating belt 204, the plates 218 are sent-out from the heating device 200 (arrow OUT). The pair of plates 218 that have been sent-out from the heating device 200 are adhered by the adhesive 218, that fused and spread, cooling and hardening.

Note that the present invention is not limited to the above-described exemplary embodiments.

The printer 10 does not have to be a dry-type electrophotographic printer using a solid developer, and may use a liquid developer. Further, a thermocouple may be used instead of the thermistor 134 as the sensor of the temperature of the fixing belt 102.

The position of mounting the thermistor 134 is not limited to the inner peripheral surface of the fixing belt 102, and the thermistor 134 may be mounted to the outer peripheral surface side of the fixing belt 102. In this case, a non-contact-sensing-type temperature sensor is used. Further, if conversion of the temperature is set in advance, the thermistor 134 may be mounted to the surface of the pressure-applying roller 104.

The cross-sectional shape of the convex portion 116 of the temperature-sensitive magnetic member 114 is not limited to rectangular, and may be triangular, arcuate, or the like. Further, the directions in which the slits 186 are formed are not limited to being straight, and may be inclined directions.

Other than being used for fusing and adhering, the heating device 200 may be used as a drier.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a magnetic field generating unit that generates a magnetic field;

a heat-generating member that is disposed so as to face the magnetic field generating unit, and generates heat due to electromagnetic induction of the magnetic field, and having a heat-generating layer of a thickness that is thinner than a skin depth; and a temperature-sensitive member that is disposed so as to face a side of the heat-generating member opposite to a side at which the magnetic field generating unit is located, a magnetic permeability of the temperature-sensitive member starting to decrease continuously from a magnetic permeability change start temperature that is in a temperature region that is greater than or equal to a set temperature and less than or equal to a heat-resistant temperature, and a convex portion, that projects out toward the heat-generating member from a surface that faces the heat-generating member, being provided at the temperature-sensitive member.

2. The heating device of claim 1, wherein the temperature-sensitive member extends longer than the magnetic field generating unit.

3. The heating device of claim 1, wherein the convex portion is disposed at a position that does not face the magnetic field generating unit.

4. The heating device of claim 1, wherein the convex portion is provided so as to extend in a longitudinal direction of the temperature-sensitive member that is plate-shaped.

5. The heating device of claim 1, wherein the convex portion is provided at plural places in a longitudinal direction of the temperature-sensitive member that is plate-shaped.

6. The heating device of claim 4, wherein the convex portion is provided at plural places in a transverse direction of the temperature-sensitive member that is plate-shaped.

7. The heating device of claim 1, wherein an eddy current cutting-off structure, that cuts-off eddy current that is generated by electromagnetic induction of the magnetic field, is formed at a region of the temperature-sensitive member other than the convex portion.

8. The heating device of claim 7, wherein the eddy current cutting-off structure includes slits.

9. The heating device of claim 1, wherein the convex portion contacts the heat-generating member.

10. The heating device of claim 1, wherein the heat-generating member has a substantially cylindrical shape, the surface that faces the heat-generating member is disposed inside the heat-generating member with the surface being curved in alignment with an inner surface of the heat-generating member, and the convex portion occupies from about 5% to about 25% of the surface that faces the heat-generating member, in terms of an angle around the center of the heat-generating member.

11. The heating device of claim 1, wherein the convex portion has a curved surface that faces the heat-generating member, and a curvature radius thereof is equal to or more than 1 mm, and equal to or less than that of the heat-generating member.

12. The heating device of claim 1, wherein the surface that faces the heat-generating member includes a surface of the convex portion that faces the heat-generating member, and an area of the surface of the convex portion is from about 5% to about 25% of that of the surface that faces the heat-generating member.

13. The heating device of claim 1, wherein the heat-generating member has an endless surface that moves in a predetermined direction, and a body to be heated contacts the surface and is transported.

14. The heating device of claim 13, wherein the temperature-sensitive member extends beyond the magnetic field generating unit at least in the predetermined direction.

15. The heating device of claim 13, wherein the endless surface forms a substantially cylindrical surface at a position facing the magnetic field generating unit.

16. The heating device of claim 13, wherein the endless surface forms a substantially planar surface at a position facing the magnetic field generating unit.

17. A fixing device comprising: the heating device of claim 1, wherein the heat-generating member is a fixing rotating body whose both end portions are rotatably supported, and the fixing device further includes a pressure-applying rotating body that contacts an outer peripheral surface of the fixing rotating body and fixes a developer image, that is on a recording medium passing between the pressure-applying rotating body and the fixing rotating body, to the recording medium.

18. The fixing device of claim 17, wherein the convex portion is provided at a position at which the fixing rotating body is nearest to the temperature-sensitive member at a time when the pressure-applying rotating body contacts the fixing rotating body.

19. An image forming device comprising:

the fixing device of claim 17;

an exposure section that emits exposure light;

a developing section that develops a latent image, that is formed by the exposure light, by a developer so as to form a developer image;

a transfer section that transfers the developer image, that is developed at the developing section, onto a recording medium; and a transporting section that transports the recording medium, onto which the developer image is transferred at the transfer section, to the fixing device.

* * * * *